US010292551B2

(12) United States Patent
Seasholtz et al.

(10) Patent No.: US 10,292,551 B2
(45) Date of Patent: May 21, 2019

(54) VACUUM CLEANER SWITCH ASSEMBLY

(71) Applicant: SHOP VAC CORPORATION, Williamsport, PA (US)

(72) Inventors: Craig A. Seasholtz, Avis, PA (US); Robert Lent Crevling, Jr., Williamsport, PA (US); Randy L. Buss, Muncy, PA (US); Kevin D. Fry, South Williamsport, PA (US)

(73) Assignee: SHOP VAC CORPORATION, Williamsport, PA (US)

( * ) Notice: Subject to any disclaimer, the term of this patent is extended or adjusted under 35 U.S.C. 154(b) by 182 days.

(21) Appl. No.: 15/434,857

(22) Filed: Feb. 16, 2017

(65) Prior Publication Data

US 2017/0156556 A1 Jun. 8, 2017

Related U.S. Application Data

(62) Division of application No. 14/830,441, filed on Aug. 19, 2015, now Pat. No. 9,591,954.

(51) Int. Cl.
*A47L 9/28* (2006.01)
*A47L 7/00* (2006.01)
(Continued)

(52) U.S. Cl.
CPC ..... *A47L 7/0028* (2013.01); *A47L 5/365* (2013.01); *A47L 7/0038* (2013.01); *A47L 9/009* (2013.01); *A47L 9/2842* (2013.01); *A47L 9/2857* (2013.01); *H01H 13/14* (2013.01); *H01H 35/18* (2013.01); *H01H 2221/036* (2013.01); *H01H 2231/012* (2013.01)

(58) Field of Classification Search
CPC ..... A47L 7/0028; A47L 5/365; A47L 7/0038; A47L 9/009; A47L 9/2842; A47L 9/2857; H01H 13/14; H01H 35/18; H01H 2221/036; H01H 2231/012
See application file for complete search history.

(56) References Cited

U.S. PATENT DOCUMENTS 5,918,344 A 7/1999 Crevling, Jr. et al.
5,966,775 A 10/1999 Berfield
(Continued)

FOREIGN PATENT DOCUMENTS

AU 740214 B2 11/2001

OTHER PUBLICATIONS

International Search Report and Written Opinion for Application No. PCT/US2016/038705, dated Sep. 26, 2016.

*Primary Examiner* — Robert J Scruggs
(74) *Attorney, Agent, or Firm* — Marshall, Gerstein & Borun LLP

(57) ABSTRACT

A switch assembly for a wet/dry vacuum cleaner is disclosed. The switch assembly includes a switch movable by a user between an ON position and an OFF position. An automatic shutoff assembly is operable in conjunction with the switch assembly to turn the switch to the OFF position in the event that a level of liquid within a tank of the wet/dry vacuum cleaner rises above a predetermined level. When triggered, the automatic shutoff assembly exerts a biasing force urging the switch toward the OFF position. A user can manually override the automatic shutoff assembly by providing a force sufficient to overcome the biasing force.

4 Claims, 11 Drawing Sheets

(51) Int. Cl.

| | |
|---|---|
| ***A47L 5/36*** | (2006.01) |
| ***H01H 13/14*** | (2006.01) |
| ***A47L 9/00*** | (2006.01) |
| ***H01H 35/18*** | (2006.01) |

(56) References Cited

U.S. PATENT DOCUMENTS

| | | | | |
|---|---|---|---|---|
| 6,009,596 | A | 1/2000 | Buss et al. | |
| 6,112,366 | A | 9/2000 | Berfield | |
| 6,119,304 | A | 9/2000 | Berfield et al. | |
| 6,610,952 | B2 | 8/2003 | Crevling | |
| 9,305,727 | B2 | 4/2016 | Holsten | |
| 2002/0074219 | A1* | 6/2002 | Crevling ..... | A47L 7/0028 200/552 |
| 2014/0237763 | A1 | 8/2014 | Holsten et al. | |

* cited by examiner

VACUUM CLEANER SWITCH ASSEMBLY

CROSS-REFERENCE TO RELATED APPLICATIONS

This is a divisional of and claims priority to U.S. patent application Ser. No. 14/830,441, filed Aug. 19, 2015, the entire contents of which are expressly incorporated herein by reference.

FIELD OF DISCLOSURE

The present disclosure generally relates to wet/dry vacuum cleaners and, more particularly, to wet/dry vacuum cleaners having the ability to automatically shutoff in response to an operating condition.

BACKGROUND OF THE DISCLOSURE

Wet/dry vacuum cleaners are devices that provide suction to pick up solid and liquid material from a surface. They are commonly used to clean garages, basements, workshops, construction sites, and other places where a combination dust, dirt, water, and other debris tend to collect. Wet/dry vacuum cleaners typically include a tank with an open top and a removable lid covering the open top. Typically, the lid houses a motor for driving a vacuum impeller. During operation, the vacuum impeller creates low pressure in the tank which draws solids, liquids, and gases therein.

Once full, the tank must be emptied by the user. The user can remove the lid and tilt the tank to empty its contents. However, this task can be cumbersome since the tank is usually heavy and unwieldy once full. Some wet/dry vacuum cleaners incorporate a port at the bottom of the tank that can be opened to drain liquid from inside the tank. However, draining the tank is feasible only if a floor drain or sewer is nearby.

Some wet/dry vacuum cleaners include a pumping mechanism which can be used to eject the contents of the tank. These wet/dry vacuum cleaners typically have an elongated motor shaft on which are mounted a vacuum impeller for drawing material into the tank and a pump impeller for discharging liquid from the tank. When the vacuum cleaner is used to suction liquid, it is generally preferred that the fluid level inside the tank not rise above the vacuum impeller. Therefore, such wet/dry vacuum cleaners typically include an automatic shutoff mechanism which interrupts power to the motor in the event that the liquid in the tank rises above a certain level.

Conventional automatic shutoff mechanisms typically include a float connected directly to a power switch. The float is positioned in the tank so that it rises with the fluid level. The upward buoyant force of the float is typically transmitted directly to the switch via a transmission rod. In some cases, the upward buoyant force of the float may be insufficient to immediately turn OFF the switch, particularly if the switch is biased to its ON position by a spring and/or if the switch has become rigid due to rust and/or wear. As a result, the automatic shutoff mechanism may not turn OFF the switch until after the fluid level has risen above an undesirable level, or not at all if the switch is particularly stiff. Additionally, since the upward buoyant force of the float may be weak, conventional automatic shutoff mechanisms may be compatible with a limited number of switches and/or may require a sensitive switch, such as a microswitch, which can be expensive.

Accordingly, the present disclosure sets forth wet/dry vacuum cleaners and automatic shutoff assemblies that embody advantageous alternatives to existing wet/dry vacuum cleaners and automatic shutoff assemblies, and that may address one or more of the challenges or needs mentioned above, as well as provides other benefits and advantages.

SUMMARY

One aspect of the present disclosure includes a wet/dry vacuum cleaner comprised of a tank, a removable lid, a motor, a rotatable shaft, a vacuum impeller, a pump impeller, a switch, a plunger assembly attached to the removable lid, a float disposed in the tank, and a transmission rod connected between the float and the plunger assembly. The tank may have an open top to which the removable lid is attached. The rotatable shaft may extend from the motor, and the vacuum and pump impellers may each be driven by the rotatable shaft. The switch may have an ON position in which power is supplied to the motor and an OFF position in which power to the motor is interrupted. The plunger assembly may have a spring and a pin. The spring may be configured to exert a biasing force against the pin to urge the switch toward the OFF position in response to upward movement of the float.

Another aspect of the present disclosure provides an automatic shutoff assembly for a wet/dry vacuum cleaner having a switch and a float. The automatic shutoff assembly may be comprised of a housing having an opening, a plunger arm, a plunger pin at least partly disposed in the housing, a spring, a first catch, and a second catch. The plunger arm may be rotatably connected to the housing, and the plunger arm may rotate from a first position to a second position in response to upward movement of the float. The plunger pin may be movable through the opening in the housing. The plunger pin may have a retracted position in which at least a portion of the plunger pin is disposed inside the housing and an extended position in which at least a portion of the plunger pin is disposed outside the housing. The spring may be disposed in the housing and configured to exert a biasing force urging the plunger pin toward the extended position. The plunger pin may transmit the biasing force of the spring to the switch when the plunger pin occupies the extended position. The first catch may be disposed on the plunger pin and the second catch may be disposed on the plunger arm. The second catch may lockingly engage the first catch to inhibit the plunger pin from moving to the second position when the plunger arm and the plunger pin occupy, respectively, the first position and the retracted position.

Yet another aspect of the present disclosure provides a wet/dry vacuum cleaner switch assembly comprised of a switch, an actuator, a rotatable arm, a spring-loaded pin connected between the actuator and the rotatable arm, and a float. The switch may include a first terminal and a second terminal. The switch may have an ON position in which the first and second terminals are electrically connected to each other and an OFF position in which the first and second terminals are electrically disconnected from each other. The actuator may be operatively connected to the switch and user engageable to selectively move the switch to the ON position and the OFF position. The rotatable arm may have a first end and a second end. The spring-loaded pin may be operatively connected to the switch and normally held in a retracted state by the first end of the rotatable arm. The spring-loaded pin may be released from the retracted state by rotating the rotatable arm. Also, the spring-loaded pin may exert a biasing force urging the switch toward the OFF position when released. The float may be operatively connected to the second end of the rotatable arm Such that upward movement of the float causes the rotatable arm to rotate and release the spring-loaded pin.

BRIEF DESCRIPTION OF THE DRAWINGS

It is believed that the disclosure will be more fully understood from the following description taken in conjunction with the accompanying drawings. Some of the figures may have been simplified by the omission of selected elements for the purpose of more clearly showing other elements. Such omissions of elements in some figures are not necessarily indicative of the presence or absence of particular elements in any of the exemplary embodiments, except as may be explicitly delineated in the corresponding written description. None of the drawings are necessarily to scale.

DETAILED DESCRIPTION

The present disclosure generally concerns an automatic shutoff assembly triggered by the upward movement of a float of a wet/dry vacuum cleaner. When activated, the automatic shutoff assembly provides a biasing force that urges a switch of the wet/dry vacuum cleaner to an OFF position. The biasing force of the automatic shutoff assembly amplifies the upward buoyant force of the float and thus increases the likelihood that the switch is promptly shifted to the OFF position when the fluid level in the tank reaches a predetermined level. Accordingly, the automatic shutoff assembly of the present disclosure may be more reliable than conventional automatic shutoff assemblies which rely solely on the upward buoyant force of the float to bias the switch to the OFF position. Furthermore, the automatic shutoff assembly of the present disclosure allows a user to manually override the biasing force and return the switch to its ON position by manually biasing the switch to the ON position. When the user releases the switch, it may return to the OFF position under the biasing force of the automatic shutoff assembly so long as the float remains in the raised position. Accordingly, the automatic shutoff assembly provides the user with flexibility in choosing when to suspend the automatic shutoff functionality.

Each of the foregoing components and advantages of the automatic shutoff assembly will be now be described in more detail with reference to the accompanying figures.

Figure 1:
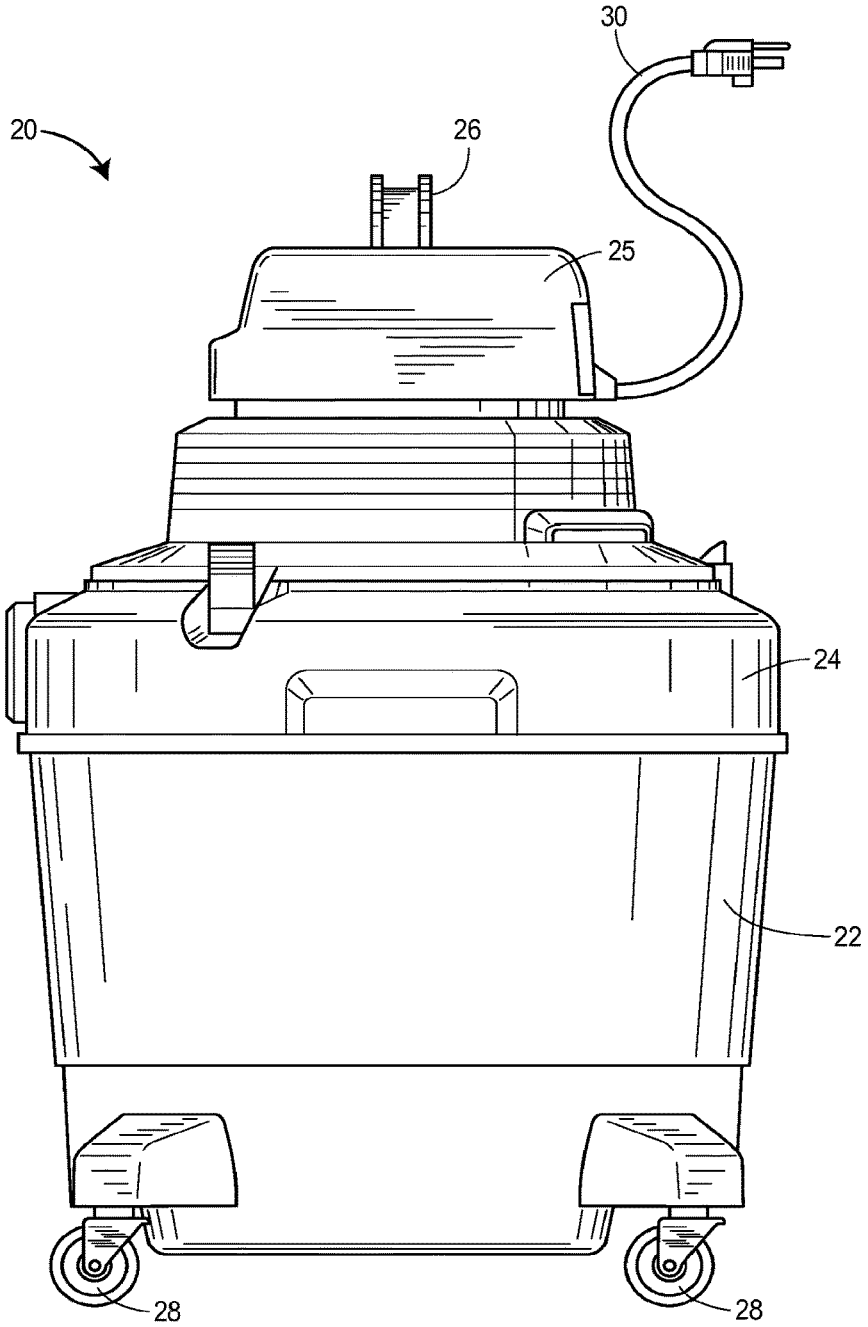
FIG. 1 is a side view of one embodiment of a wet/dry vacuum cleaner constructed in accordance with principles of the present disclosure.

Referring to FIG. 1, illustrated is a wet/dry vacuum cleaner 20 constructed in accordance with principles of the present disclosure. While the depicted vacuum cleaner is a wet/dry vacuum cleaner, the automatic shutoff assembly of the present disclosure can be implemented with other types of vacuum cleaners, as well as pumps and any other device benefitting from the ability to automatically turn OFF in response to an operational condition.

As illustrated in FIG. 1, the wet/dry vacuum cleaner 20 includes a tank 22 to which a lid 24 is removably attached. The lid 24 covers an open end (not depicted) of the tank 22. A cover 25 may be disposed on top of and fixedly attached to the lid 24. The cover 25 may include a handle 26 to facilitate removal of the lid 24 and the cover 25 from the tank 22. The handle 26 may also be used to assist a user in lifting and moving the wet/dry vacuum cleaner 20 when the lid 24 is locked onto the tank 22. A plurality of casters or other types of wheels 28 are attached to the underside of the tank 22 to facilitate movement. An electric power cord 30 extends from the cover 25 and provides power to the wet/dry vacuum cleaner 20 from an electrical outlet, for example.

Figure 2:
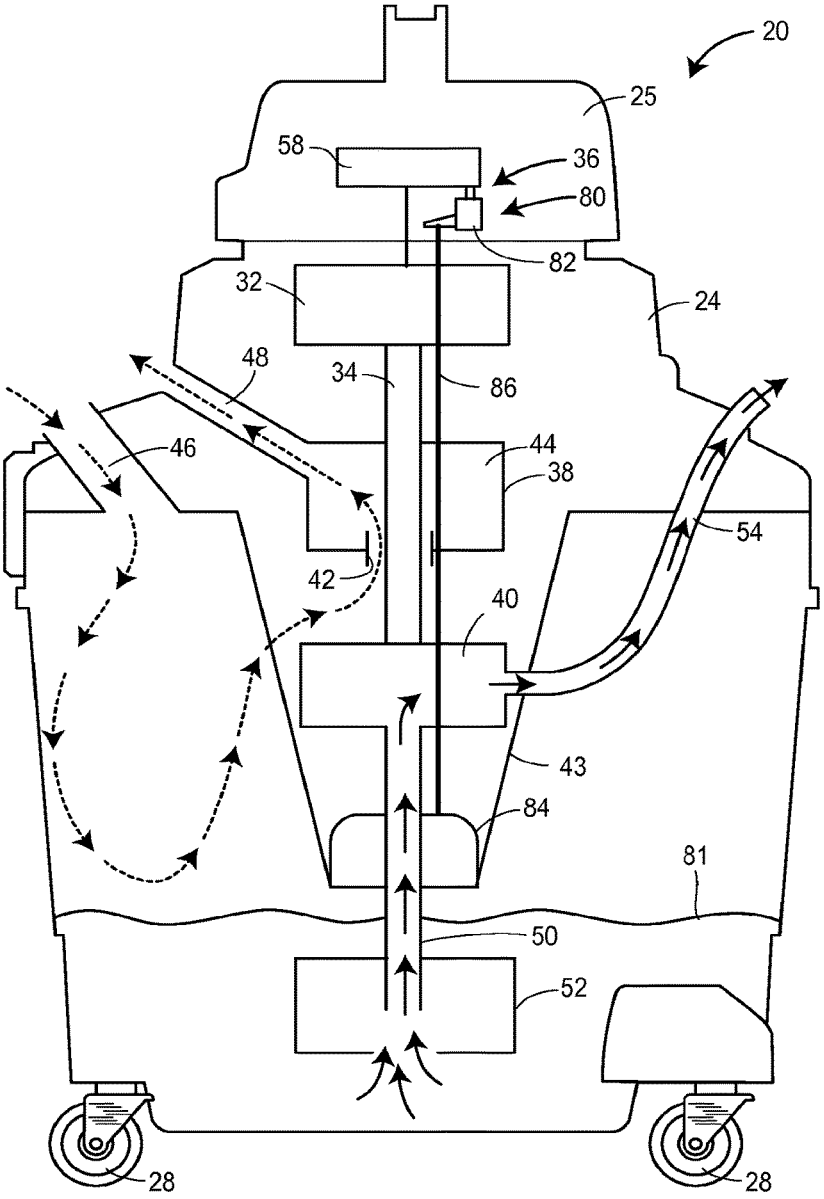
FIG. 2 is a schematic view depicting various internal components of the wet/dry vacuum cleaner of FIG. 1.

FIG. 2 is a schematic diagram illustrating the general electrical and mechanical operation of the wet/dry vacuum cleaner 20. An electric motor 32 is located inside the lid 24 and rotates a rotatable shaft 34 when supplied with electric power. As discussed below in more detail, the supply of electric power to the electric motor 32 may be toggled by a switch assembly 36.

The motor 32 drives a vacuum impeller 38 and a pump impeller 40 via the rotatable shaft 34. Each of the vacuum impeller 38 and the pump impeller 40 may be mounted on, and rotate together with, the rotatable shaft 34. The rotatable shaft 34 illustrated in FIG. 2 is a single, unitary structure. In alternative embodiments, the rotatable shaft 34 may be formed in two separate portions, with a first portion extending between the motor 32 and the vacuum impeller 38 and a second portion, which is collinear with the first portion, extending between the vacuum impeller 38 and the pump impeller 40.

Figure 3:
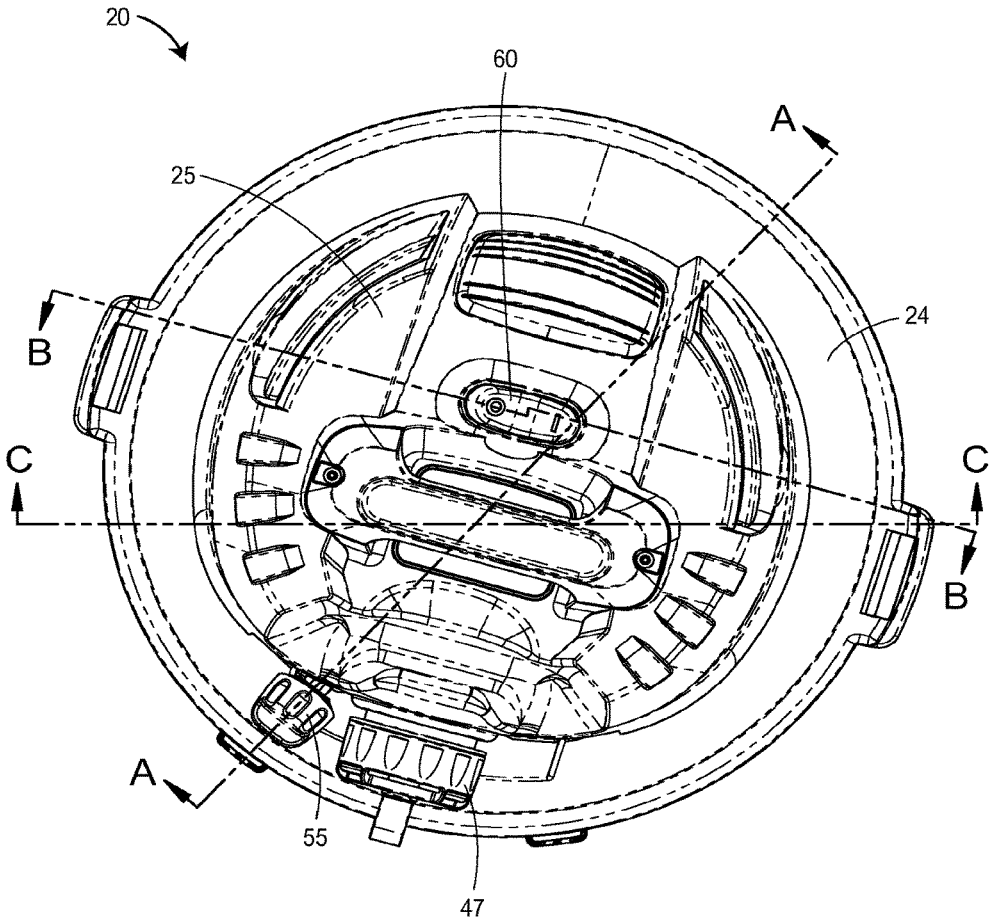
FIG. 3 is a top view of the wet/dry vacuum cleaner of FIG. 1.

The vacuum impeller 38 draws air through an opening 42 in a vacuum impeller housing 44 from the tank 22, which in turn draws air and other material through an inlet 46. A filter cage 43 may be suspended from the lid 24 and configured to hold a filter (not illustrated) that removes particulates from the air flow before it is drawn into the vacuum impeller housing 44. The mouth of the inlet 46 may be threaded or may include some other means to facilitate the attachment of a hose (not illustrated) or other device for extending the reach of the wet/dry vacuum cleaner 20. While the inlet 46 of the present embodiment is formed in the lid 24, in other embodiments it may be formed in the sidewall of the tank 22. Air may be expelled directly from the vacuum impeller 44 through an exhaust port 48 as shown in FIG. 2. A reduction in noise may be accomplished by covering the exhaust port 48 with a removable cap 47 (see FIG. 3). The removable cap 47 may have one or more apertures (not illustrated) extending through its end surface, thereby allowing air to be expelled from the exhaust port 48, albeit at a slower rate than if the exhaust port 48 was uncovered. Since the removable cap 47 may create a flow restriction, the removable cap 47 may be removed from the exhaust port 48 when maximum performance of the wet/dry vacuum cleaner 20 is preferred. In some embodiments, the removable cap 47 may threadably engage the exhaust port 48 to facilitate its removal and attachment.

The pump impeller 40 is driven by the portion of the rotatable shaft 34 passing through the opening 42 in the vacuum impeller housing 44. An intake tube 50 extends downwardly from the pump impeller 40 into the tank 22 and terminates inside a pump intake assembly 52. Rotation of the pump impeller 40 draws liquid into and through the inlet tube 50. Liquid reaching the pump impeller 40 is discharged from the tank 22 through a discharge tube 54.

Figure 4:
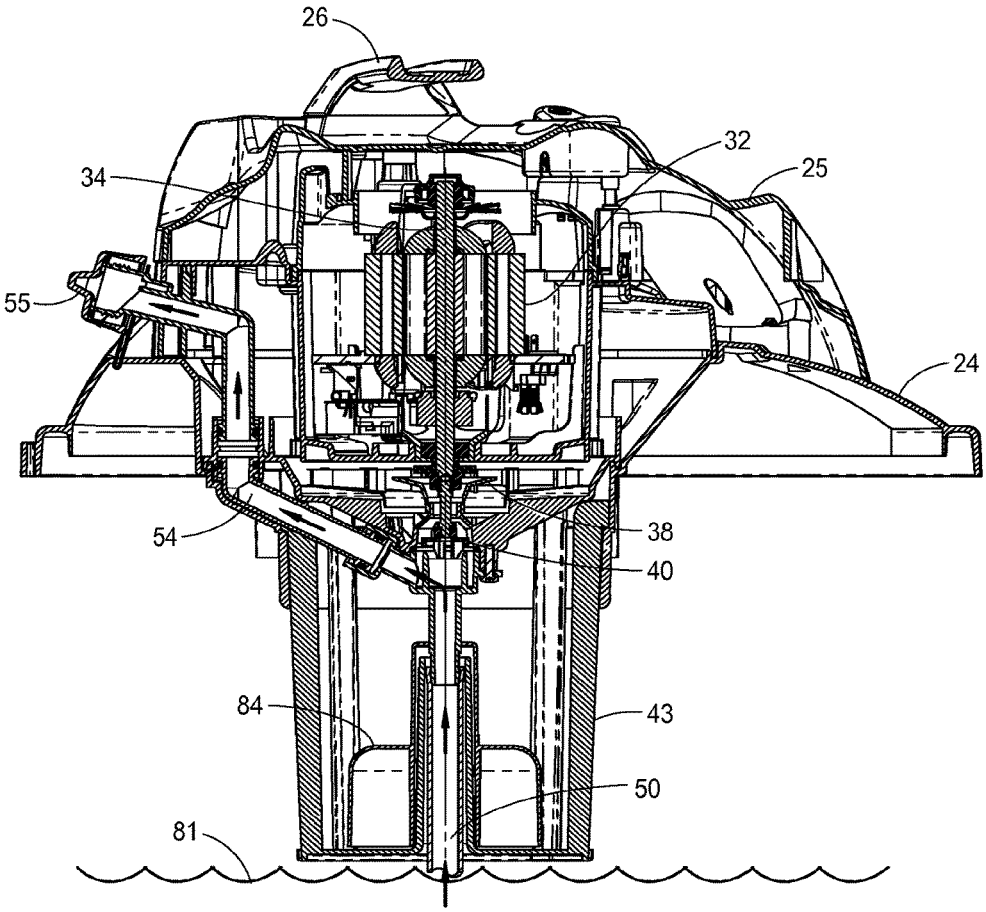
FIG. 4 is a cross-sectional view taken along line A-A of FIG. 3.

A more detailed illustration of one embodiment of the discharge tube 54 is shown in FIG. 4. An end of the discharge tube 54 protruding from the lid 24 may be threaded or provided with some other means so that a cap 55 or a hose (not illustrated) may be removably attached to the outlet of the discharge tube 54.

Figure 5:
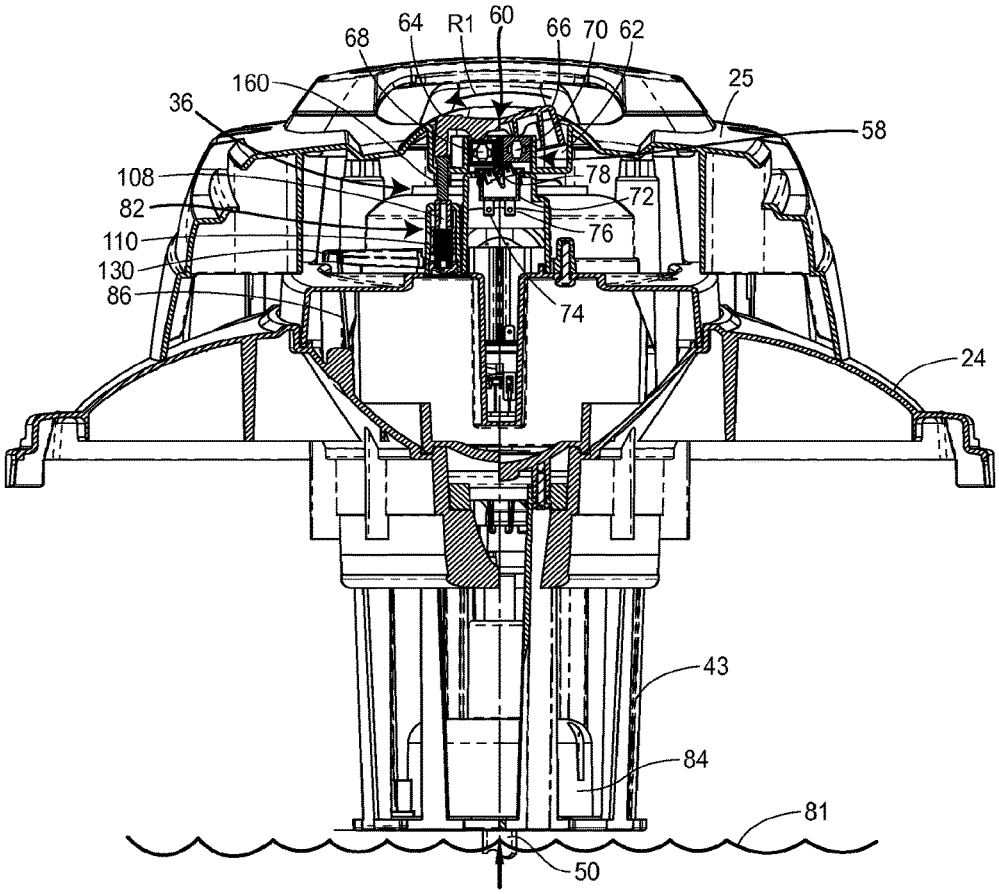
FIG. 5 is a cross-sectional view taken along line B-B of FIG. 3.
Figure 13:
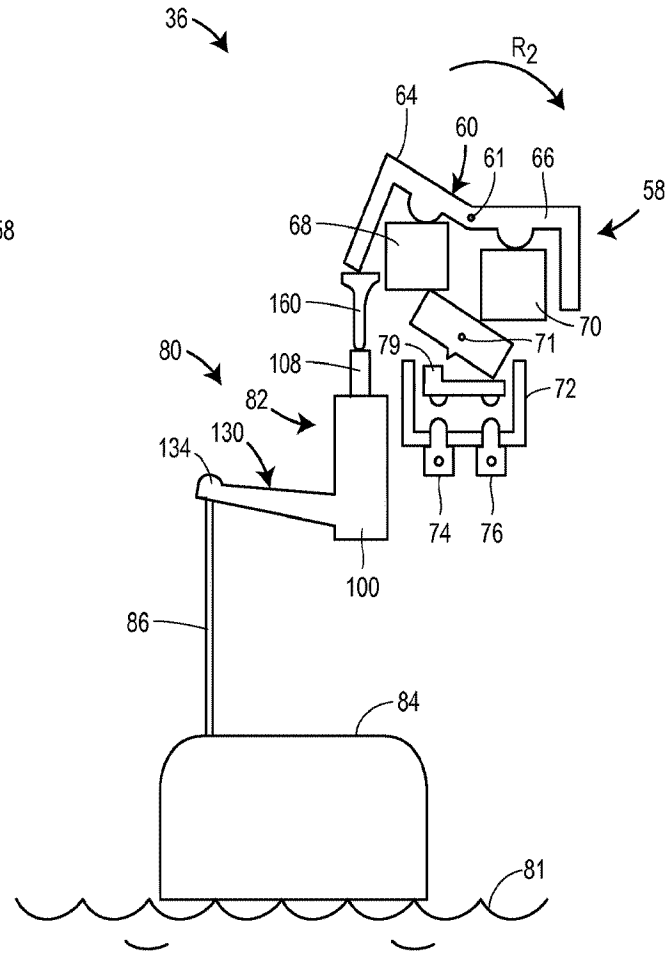
FIG. 13 depicts the automatic shutoff assembly of FIG. 12 arranged in an activated position so that the automatic shutoff assembly biases the switch to an OFF position.
Figure 12:
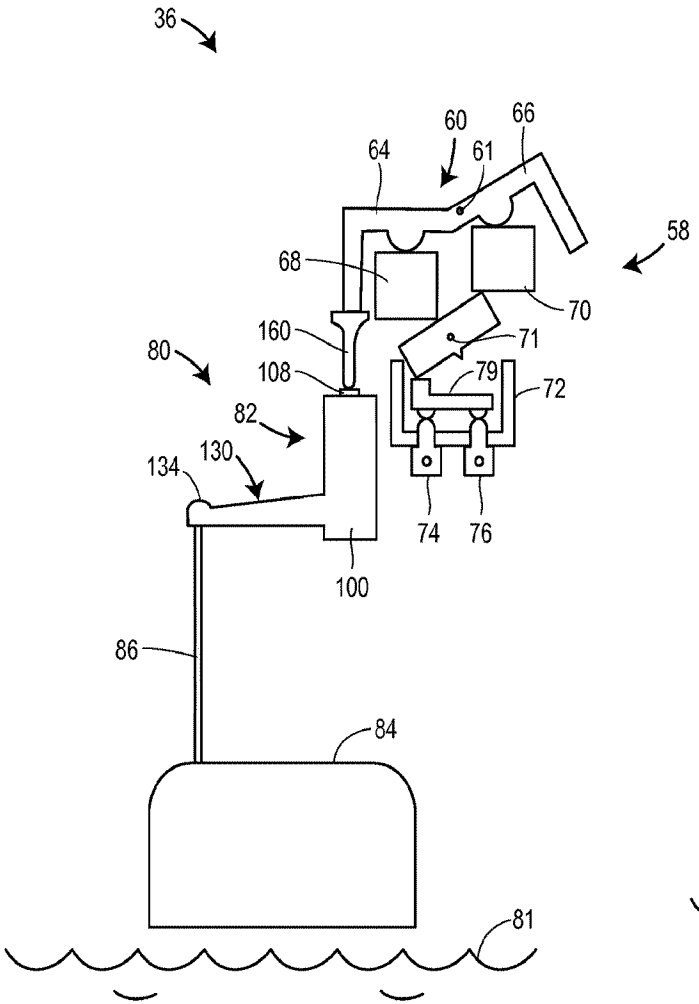
FIG. 12 is a side schematic view of one embodiment of an automatic shutoff assembly in combination with a switch, where the automatic shutoff assembly is arranged in a deactivated position and the switch is arranged in an ON position.

Turning to FIG. 5, and as shown in FIGS. 12 and 13, the switch assembly 36 is shown to include a switch 58 having a rocker arm 60 rotatably attached to the cover 25. The rocker arm 60 is partially disposed within a recess 62 formed in the outer surface of the cover 25 such that rotating the rocker arm 60 in a first rotational direction R1 causes a first end 64 of the rocker arm 60 to be depressed into the recess 62 and a second end 66 of the rocker arm 60 to protrude outwardly from the recess 62. When the rocker arm 60 is rotated in a second rotational direction R2, opposite the first rotational direction R1, the second end 66 of the rocker arm 60 may be depressed into the recess 62 and the first end 64 of the rocker arm 60 may protrude outwardly from the recess 62. A user may manually rotate the rocker arm 60 in the first rotational direction R1 by pushing down on the first end 64 of the rocker arm 60, and manually rotate the rocker arm 60 in the second rotational direction R2 by pushing down on the second end 66 of the rocker arm 60.

Still referring to FIG. 5, a first extension member 68 is mounted for reciprocating motion proximate to the first end 64 of the rocker arm 60 and a second extension member 70 is mounted for reciprocating motion proximate to the second end 66 of the rocker arm 60. The switch 58 further includes a housing 72 from which first and second terminals 74 and 76 extend. A movable arm 78 is mounted within the switch housing 72 on a pivot 71 and is configured to move an electric contact 79 to: (a) a first or ON position where the electric contact 79 electrically connects the first and second terminals 74 and 76 when the first end 64 of the rocker arm 60 is depressed into the recess 62 (see FIG. 12), and (b) a second or OFF position where the electric contact 79 electrically disconnects the terminals 74 and 76 when the second end 66 of the rocker arm 60 is depressed into the recess 62 (see FIG. 13). While various internal components of the housing 72 of the switch 58 may not be illustrated and/or may be illustrated in schematic form only, a person of ordinary skill in the art would understand various ways to construct the switch 58, and would understand that a variety of different types of conventional switches could be used for the switch 58. The electric contact 79 and the first and second terminals 74 and 76 may be made of an electrically conductive material (e.g., copper) such that when the movable arm 78 moves the electric contact 79 to the ON position, the terminals 74 and 76 are electrically connected and a circuit is completed to thereby electrically connect the electric power cord 30 to the motor 32 for energization thereof. When supplied with electricity, the motor 32 may rotate the rotatable shaft 34, which in turn may rotate the vacuum impeller 38 and the pump impeller 40.

With continued reference to FIGS. 5 and 12, when it is desired to operate the vacuum impeller 38 and/or pump impeller 40, a user can depress the first end 64 of the rocker arm 60 into the recess 62. This causes the first extension member 68 to act upon and pivot the movable arm 78 to the ON position. When it is desired to cease operation of the vacuum impeller 38 and/or pump impeller 40, a user can depress the second end 66 of the rocker arm 60 into the recess 62. This causes the second extension member 70 to act upon and pivot the movable arm 78 to the OFF position. Accordingly, the rocker arm 60 may function as an actuator allowing the user to toggle the switch 58 between the ON and OFF positions.

Since the vacuum impeller 38 and pump impeller 40 may be driven simultaneously by the rotatable shaft 34, the outlet of the discharge tube 54 may be covered with the cap 55 (see, e.g., FIG. 4) if the motor 32 is to be used solely to suction material into the tank 22 with the vacuum impeller 38. On the other hand, the exhaust port 48 may be covered with the cap 47 (see, e.g., FIG. 3) if the motor 32 is to be used solely to discharge the contents of the tank 22 with the pump impeller 40.

Figure 6:
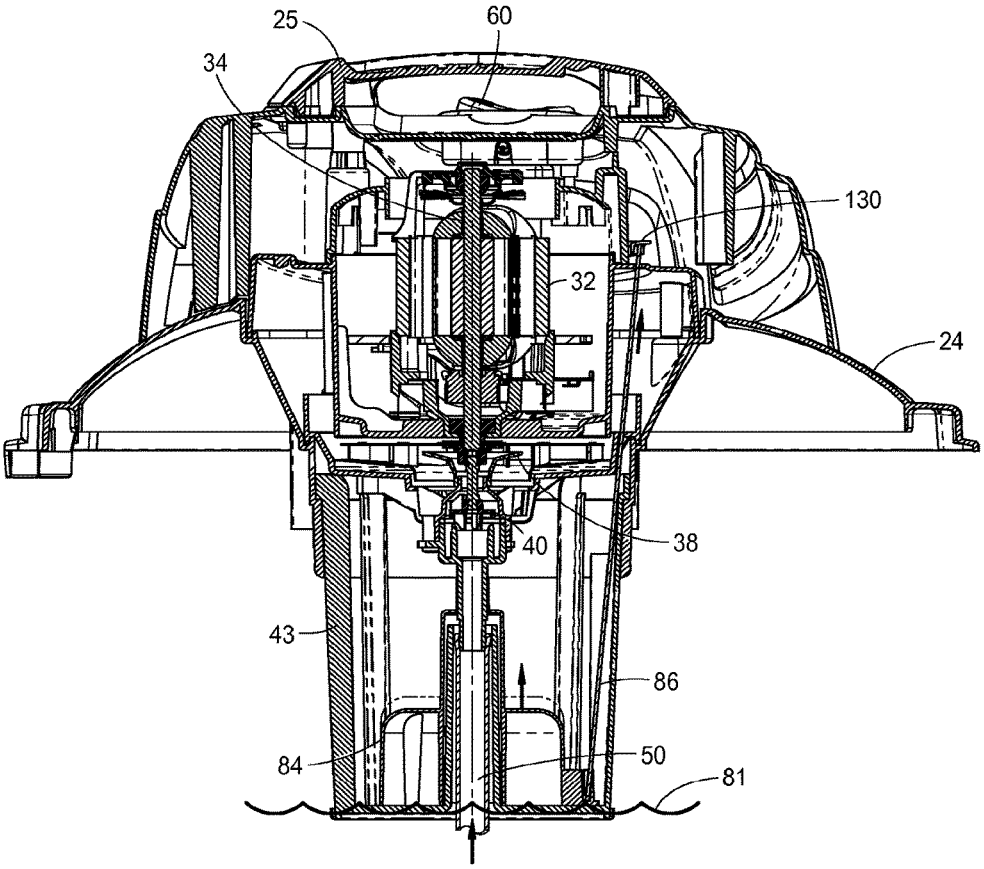
FIG. 6 is a cross-sectional view taken along line C-C of FIG. 3.
Figure 7:
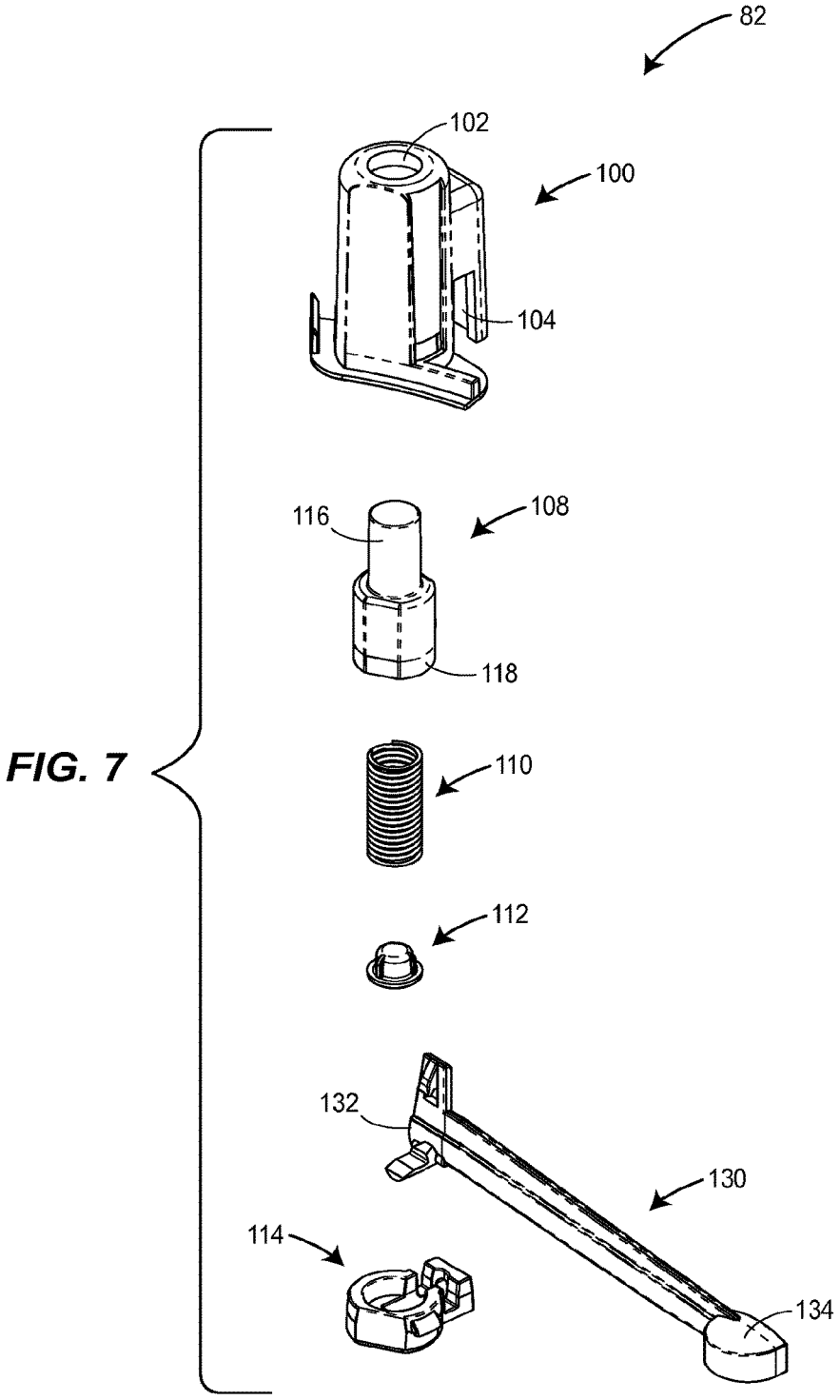
FIG. 7 is an exploded assembly view of one embodiment of a plunger assembly constructed in accordance with principles of the present disclosure.
Figure 8:
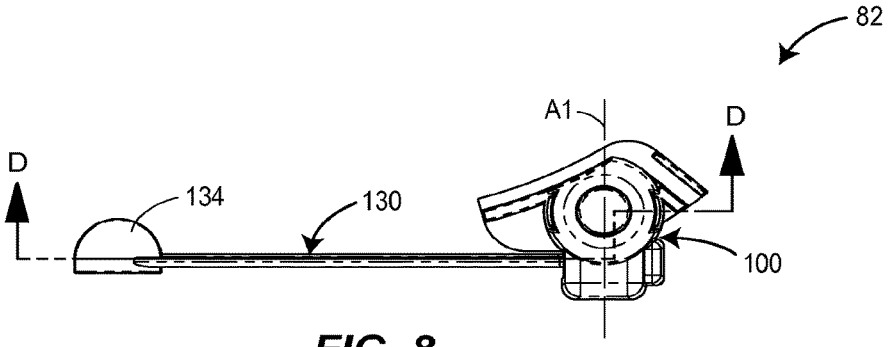
FIG. 8 is a top view of the plunger assembly of FIG. 7 in an assembled form.

Referring again to FIG. 2, the switch assembly 36 may also include an automatic shutoff assembly 80. The automatic shutoff assembly 80 may include a plunger assembly 82, a float 84 mounted in the disclosed version for generally linear reciprocal motion within the filter cage 43, and a transmission rod 86 connecting the float 84 and the plunger assembly 82. An unobstructed view of the transmission rod 86 is seen in FIG. 6. The float 84 may have a density less than a liquid (e.g., water) that fills the tank 22 so that the float 84 rises in the upward direction if it contacts the upper surface of the liquid. In some embodiments, the float 84 may include a geometrical configuration (e.g., an inverted cup shape) that rises in an upward direction in response to contact with the top surface of the rising liquid 81 in the tank 22. The upward movement of the float 84 pushes the transmission rod 86 in the upward direction, which in turn activates or triggers the plunger assembly 82. As discussed below in more detail, the plunger assembly 82 is configured to exert a biasing force urging the switch 58 to the OFF position when activated. Accordingly, the automatic shutoff assembly 80 automatically interrupts or cuts off the supply of electricity to the motor 34 when fluid 81 in the tank 22 rises to a level causing the float 84 to rise. When the fluid level in the tank 22 drops, the float 84 moves in the downward direction under the pull of gravity, which in turns causes the transmission rod 86 to move in the downward direction. However, as discussed below, downward movement of the transmission rod 86 does not by itself deactivate the plunger assembly 82. The user must also rotate the rocker arm 60 in the first rotational direction R1 to the position shown in FIG. 12 to deactivate the plunger assembly 82. Once deactivated, the plunger assembly 82 may no longer exert a biasing force urging the switch 58 to the OFF position.

Referring now to FIGS. 7-11, a more detailed description of one embodiment of the plunger assembly 82 is provided.

Generally speaking, the plunger assembly 82 may take the form of a spring-loaded pin. More particularly, the plunger assembly 82 may include a housing 100 having a first opening 102 and a second opening 104, of which each provides access to a hollow interior 106. A plunger pin 108 may be mounted for linear reciprocal movement within the housing 100. The plunger pin 108 may be movable between a retracted position where the plunger pin 108 is disposed substantially inside the housing 100 (see FIGS. 9 and 10) and an extended position where the plunger 108 is disposed substantially outside the housing 100 (see FIG. 11). A compression spring 110 may be disposed in the housing 100 between a lower end of the plunger pin 108 and a spring seat 112. The compression spring 110 may exert a biasing force urging the plunger pin 108 toward the extended position. A bottom of the housing 100 may be formed by a removable base member 114, and the spring seat 112 may be disposed on top of the removable base member 114.

Figure 10:
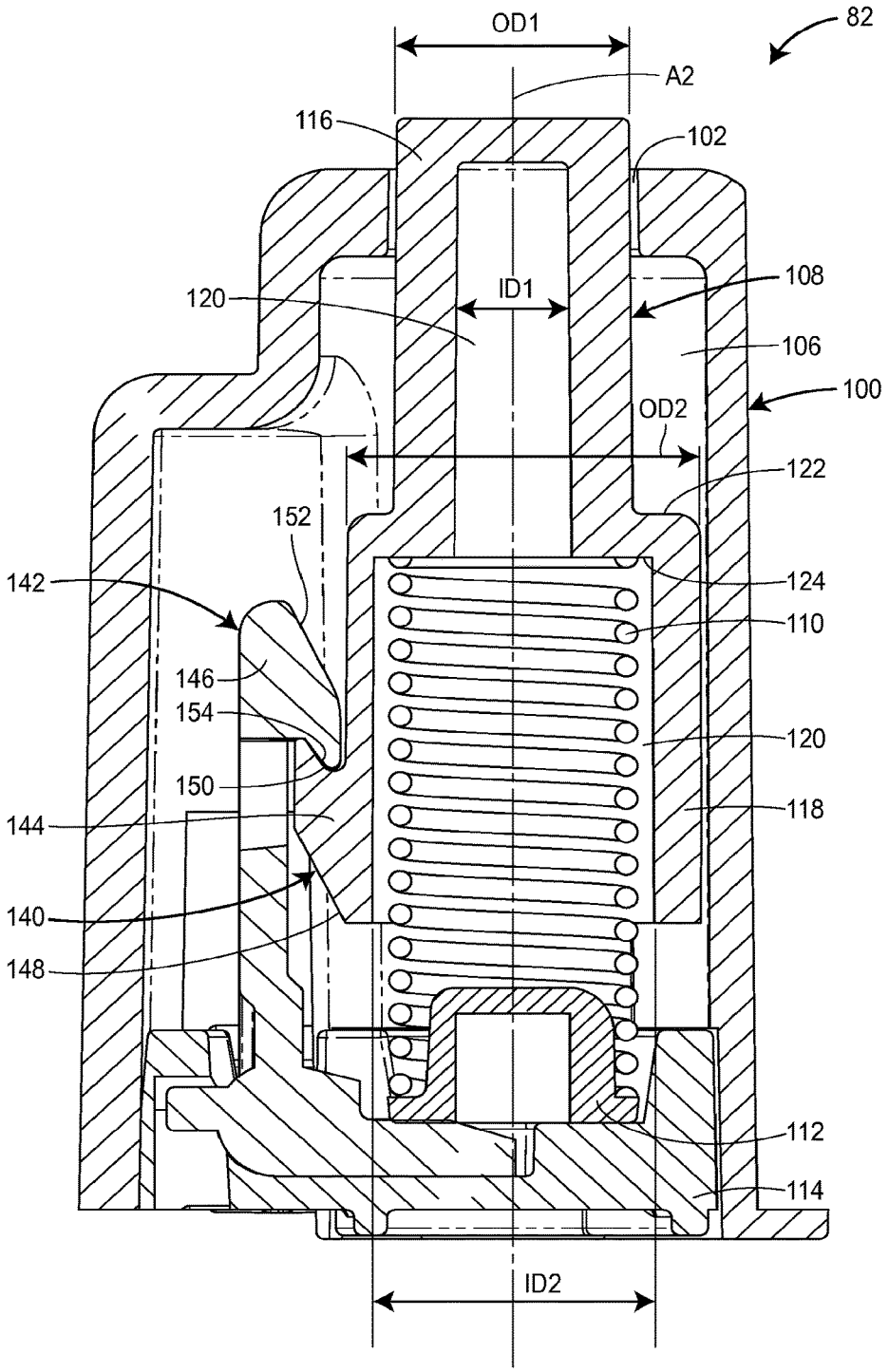
FIG. 10 is a cross-sectional view taken along line E-E of FIG. 9.

As illustrated in FIG. 10, the plunger pin 108 may take the form of a sleeve defined by a first end 116, a second end 118, and a hollow interior 120. The first end 116 may have an end wall 122 closing off the hollow interior 120, whereas the second end 118 may have an opening 124 providing access to the hollow interior 120. An inner diameter ID1 of the first end 116 may be smaller than an inner diameter ID2 of the second end 118. Therefore, an inner shoulder 124 may be formed at the interface between the inner surface of the first end 116 and the inner surface of the second end 118. The compression spring 110 may be received in the second end 118 of the plunger pin 108 and abut against the inner shoulder 124.

Furthermore, an outer diameter OD1 of the second end 118 may be larger than an outer diameter OD2 of the first end 116. Accordingly, an outer shoulder 122 may be formed at the interface between the outer surface of the first end 116 and the outer surface of the second end 118. The outer shoulder 122 may function as a stop that abuts against an inner surface of the housing 100 adjacent the first opening 102 when the plunger pin 108 occupies the extended position, as illustrated in FIG. 11.

Figure 9:
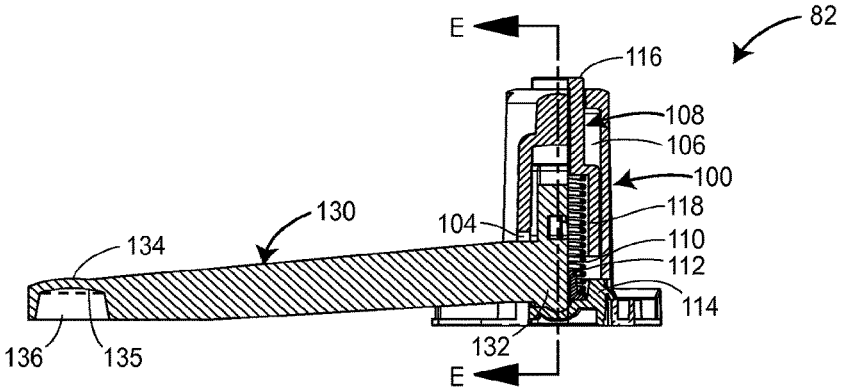
FIG. 9 is a cross-sectional view taken along line D-D of FIG. 8 when the plunger assembly is deactivated.
Figure 11:
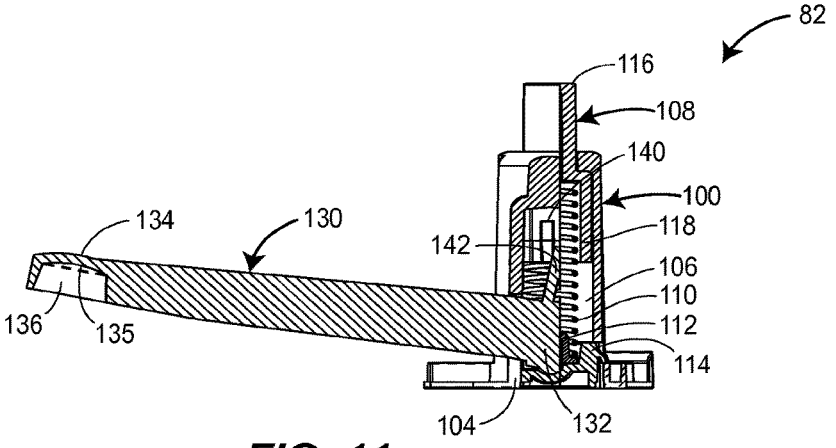
FIG. 11 is a cross-sectional view taken along line D-D of FIG. 8 when the plunger assembly is activated.

Referring to FIGS. 9 and 11, the plunger assembly 82 may include a plunger arm 130 having a first end 132 disposed within the hollow interior 106 of the housing 100. The plunger arm 130 may extend through the second opening 104 in the housing 100 such that a second end 134 of the plunger arm 130 is disposed outside the housing 100. The first end 132 of the plunger arm 130 may be rotatably attached to the base member 114 of the housing 100 such that the plunger arm 130 rotates about an axis A1 (FIG. 8) that is orthogonal to an axis A2 (FIG. 10) along which the plunger pin 108 translates. Furthermore, the first end 132 of the plunger arm 130 may be spaced apart from the axis A2.

The second end 134 of the plunger arm 130 may include a depression 136 (e.g., a cup, recess, notch, etc.) formed in its downwardly facing surface. The outer dimension of the depression 136 may be larger than that of an upper end of the transmission rod 86 such that the depression 136 can receive the upper end of the transmission rod 86. Additionally, the depression 136 may have a rounded downwardly facing surface allowing the plunger arm 130 to rotate relative to the transmission rod 86 when the transmission rod 86 rises against the plunger arm 130. In an alternative embodiment (not illustrated), the transmission rod 86 may be pinned to the second end 134 of the plunger arm 130 to form a pivotable joint therebetween.

The plunger arm 130 may rotate between a lowered position (FIG. 9) and a raised position (FIG. 11). The second end 118 of the plunger pin 108 may include a first catch 140 and the first end 132 of the plunger arm 130 may include a second catch 142.

When the plunger pin 108 occupies its retracted position and the plunger arm 130 concurrently occupies its lowered position, the first catch 140 and the second catch 142 may lockingly engage each other, as shown in FIG. 10. Accordingly, in this configuration, the plunger arm 130 may prevent the biasing force of the compression spring 110 from pushing the plunger pin 108 to its extended position and thereby maintain the plunger pin 108 in its retracted position. When the plunger arm 130 occupies its raised position (FIG. 11), the second catch 142 may disengage from the first catch 140, thereby allowing the biasing force of the compression spring 110 to push the plunger pin 108 to its extended position. Also, so long as the plunger arm 130 occupies its raised position, the second catch 142 may not engage the first catch 142. Thus, movement of the plunger pin 108 back-and-forth between its retracted position and extended position is uninhibited by the plunger arm 130 when it occupies its raised position. This aspect of the plunger assembly 82 enables the manual override procedure discussed below.

In some embodiments, such as the one illustrated in FIG. 10, the first catch 140 may be formed by a first protrusion 144 disposed on the second end 118 of the plunger pin 108 and extending generally in the upward direction at angle relative to the axis A2. The second catch 142 may be formed by a second protrusion 146 disposed on the first end 132 of the plunger arm 130 and extending generally in the downward direction at generally a complementary angle relative to the axis A2. The first protrusion 144 may possess a first ramp portion 148 generally facing away from the compression spring 110 and a first gripping portion 150 generally facing toward the compression spring 110. The second protrusion 146 may possess a second ramp portion 152 generally facing toward the compression spring 110 and a second gripping portion 154 generally facing away from the compression spring 110.

When the plunger pin 108 translates from the extended position to the retracted position and the plunger arm 130 concurrently occupies its lowered position, the first ramp portion 148 may slide over the second ramp portion 152, thereby causing the first ramp portion 148 and/or the second ramp portion 152 to elastically deform. As the plunger pin 108 continues to translate in the downward direction, the first gripping portion 148 may slip underneath and snap into engagement with the second gripping portion 154, as seen in FIG. 10. Accordingly, the first and second gripping portions 148 and 152 may lockingly engage each other such that upward movement of the plunger pin 108 is inhibited. When the plunger arm 130 is rotated to its raised position, the second gripping portion 154 may shift out of contact with the first gripping portion 150, thereby unlocking or releasing the plunger pin 108 so that the compression spring 110 can move the plunger pin 108 to its extended position.

Operation of the automatic shutoff assembly 80 will now be described with reference to FIGS. 12-14. FIG. 12 illustrates the automatic shutoff assembly 80 in a deactivated configuration. Here, the fluid level in the tank 22 remains below the resting position of the float 84. Consequently, the plunger arm 130 occupies in its lowered position, and the second catch 142 lockingly engages the first catch 140 (as seen in FIG. 10). This retains the plunger pin 108 in its retracted position and thus prevents the automatic shutoff assembly 80 from moving the rocker arm 60.

If the fluid level rises to and exceeds the resting position of the float 84, the float 84 rises in the upward direction due to the buoyant forces generated by the float 84. The upward movement of the float 84 moves the transmission rod 86 in the upward direction. The transmission rod 86 in turn pushes upwardly against the second end 134 of the plunger arm 130. The plunger arm 130 consequently rotates to its raised position, as depicted in FIG. 13. When the plunger arm 130 occupies its raised position, the second catch 142 disengages from the first catch 140, which allows the compression spring 110 to push the plunger pin 108 to its extended position. This causes the plunger pin 108 to push a third extension member 160 in the upward direction against the underside of the first end 64 of the rocker arm 60. Consequently, the biasing force of the compression spring 110 is transferred or transmitted through the plunger pin 108 and the third extension member 160 to the rocker arm 60. This causes the rocker arm 60 to rotate in the second rotational direction R2 until the second end 66 of the rocker arm 60 is depressed in the recess 62. This pushes the second extension member 70 in the downward direction, which in turn pivots the movable arm 78 of the switch 58 to the OFF position. As a result, the movable arm 78 causes the electric contact 79 to electrically disconnect the first and second terminals 74 and 76, which interrupts the supply of electrical power to the motor 32. Without electrical power, the motor 32 ceases rotating the vacuum and pump impellers 38 and 40.

Figure 14:
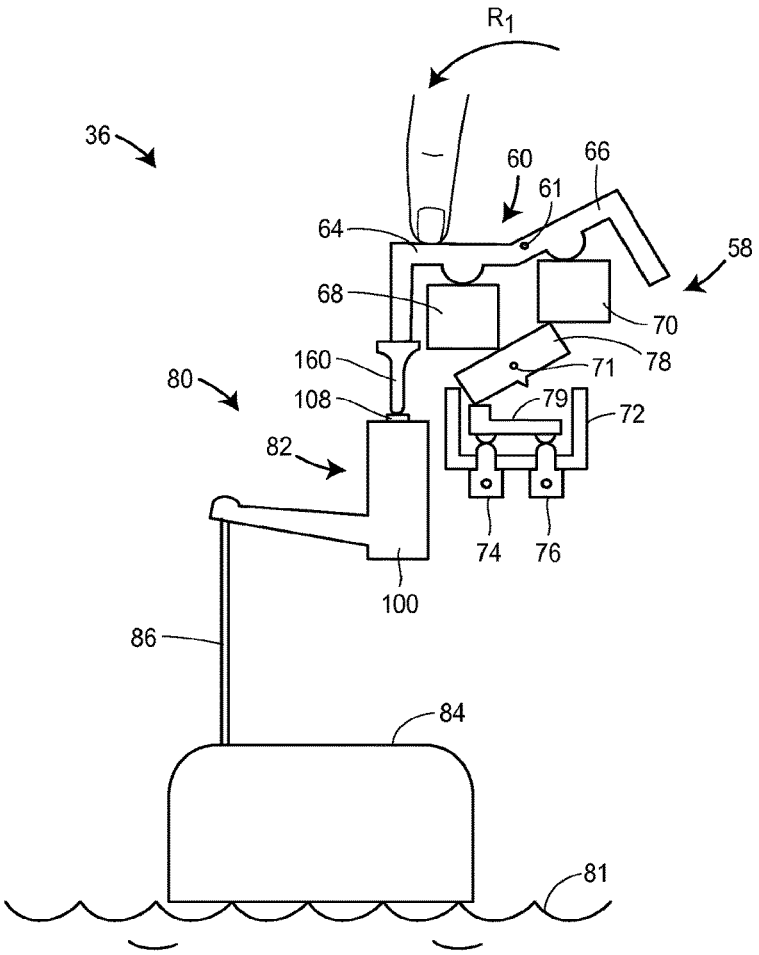
FIG. 14 illustrates a manual override of the automatic shutoff assembly depicted in FIG. 13.

In order to manually override the automatic shutoff assembly 80, the user may depress, with his or her finger 170, the first end 64 of the rocker arm 60 with sufficient force to overcome the upward biasing force generated by the compression spring 110, as depicted in FIG. 14. The user is required to continually depress the first end 64 of the rocker arm 60, otherwise the upward biasing force of the compression spring 110 will return the rocker arm 60 to the OFF position, since the plunger arm 130 will still occupy its raised position. By manually overriding the automatic shutoff assembly, the user can discharge fluid from the tank 22 with the pump impeller 84 via the discharge tube 54.

Once the level of liquid within the tank 22 drops below the resting position of the float 84, the float 84 may again occupy its resting position toward the bottom of the filter cage 43 and the transmission rod 86 may allow the plunger arm 130 to return to its lowered position. The plunger arm 130 thus occupies its lowered position. If the user depresses the first end 64 of the rocker arm 60 into the recess 62, the plunger pin 108 may be pushed to its retracted position, thereby compressing the compression spring 110 and causing the first and second catches 140 and 142 to interlock with each other. Accordingly, the automatic shutoff assembly 80 may be reset or re-loaded, so that it can be triggered again when the fluid level rises above the resting position of the float 84.

From the foregoing, it can be seen that the present disclosure advantageously provides an automatic shutoff assembly that, when triggered, provides a biasing force urging a switch of the wet/dry vacuum cleaner to an OFF position. The biasing force amplifies the upward force provided by the float and thus helps ensure that the switch is promptly and reliably shifted to the OFF position. Furthermore, the automatic shutoff assembly of the present disclosure may be compatible with a wider variety of switches than conventional automatic shutoff assemblies because it does not require a switch with a high degree of sensitivity. In addition, the automatic shutoff assembly of the present disclosure allows a user to manually override its biasing force and return the switch to the ON position, but only upon continuous depression of the switch by the user.

While the invention has been described in connection with various embodiments, it will be understood that the invention is capable of further modifications. This application is intended to cover any variations, uses or adaptations of the invention following, in general, the principles of the invention, and including such departures from the present disclosure as, within the known and customary practice within the art to which the invention pertains.

What is claimed is:

1. A wet/dry vacuum cleaner switch assembly comprising:

a switch including a first terminal and a second terminal, the switch having an ON position in which the first and second terminals are electrically connected to each other and an OFF position in which the first and second terminals are electrically disconnected from each other;

an actuator operatively connected to the switch and user engageable to selectively move the switch to the ON position and the OFF position;

a rotatable arm having a first end and a second end;

a spring-loaded pin operatively connected between the actuator and the rotatable arm and normally held in a retracted state by the first end of the rotatable arm, the spring-loaded pin being released from the retracted state by rotating the rotatable arm, the spring-loaded pin exerting a biasing force urging the switch toward the OFF position when released; and a float operatively connected to the second end of the rotatable arm such that upward movement of the float causes the rotatable arm to rotate and release the spring-loaded pin.

2. The wet/dry vacuum cleaner of claim 1, the actuator being configured to transmit a user-generated force that overcomes the biasing force of the spring-loaded pin and returns the switch to the ON position.

3. The wet/dry vacuum cleaner of claim 1, comprising a transmission rod connected between the float and the second end of the rotatable arm.

4. The wet/dry vacuum cleaner of claim 1, comprising a first catch disposed on the spring-loaded pin and a second catch disposed on the first end of the rotatable arm, the second catch lockingly engaging the first catch to retain the spring-loaded pin in the retracted state prior to being released.

* * * * *